United States Patent [19]

Almquist et al.

[11] 4,046,127

[45] Sept. 6, 1977

[54] SPARK BOOSTING DEVICE

[76] Inventors: Edgar Almquist; Richard Almquist, both of Milford, Pa. 18337

[21] Appl. No.: 646,610

[22] Filed: Jan. 5, 1976

[51] Int. Cl.[2] ..... F02P 1/00

[52] U.S. Cl. ..... 123/148 A; 313/123; 313/125; 123/169 EA; 123/169 MG

[58] Field of Search ..... 123/148 A, 169 EA, 169 TC, 123/169 MG, 148 R; 313/123, 124, 125, 126

[56] References Cited

U.S. PATENT DOCUMENTS

| | | | |
|---|---|---|---|
| 1,406,858 | 2/1922 | Henricks | 123/148 A |
| 1,548,031 | 8/1925 | Franzen | 123/148 A |
| 2,006,341 | 7/1935 | Berg et al. | 123/148 A |
| 2,202,220 | 5/1940 | Miller | 313/126 |
| 2,284,068 | 5/1942 | Roberts | 123/148 A |
| 2,564,764 | 8/1951 | Kovac | 123/148 A |
| 2,972,077 | 2/1961 | Chapman | 313/123 |
| 3,007,987 | 11/1961 | Barnes | 123/148 A |

*Primary Examiner*—Carroll B. Dority, Jr.
*Assistant Examiner*—Ronald B. Cox
*Attorney, Agent, or Firm*—Weiser, Stapler & Spivak

[57] ABSTRACT

The invention comprises a spark booster for use in the ignition system of an internal combustion engine. Two embodiments of the invention are disclosed. Each embodiment comprises two electrically conductive members which are spaced from each other to define a spark gap, a bi-metal disk for varying the size of the gap in response to variations in engine temperature, manual adjustment for adjusting the spark gap independently of temperature, and an inspection window for visually observing the spark gap. In addition to the foregoing features, one embodiment also includes apparatus for varying the size of the gap in response to the load on the engine and its speed.

20 Claims, 4 Drawing Figures

SPARK BOOSTING DEVICE

BACKGROUND OF THE INVENTION

This invention relates to a spark boosting device for an ignition system, and more particularly to a device for boosting and varying the intensity of a spark in response to a variety of conditions.

It has been well known for many years that conventional ignition systems for internal combustion engines are inefficient since the spark plugs do not develop a spark which is sufficient to maximize the efficiency and power which the engines are capable of creating.

It has been recognized that in the normal course of driving, the power requirements made on the ignition system vary with the temperature of the engine, its speed, and the power which it is required to develop.

The spark boosting devices developed heretofore have had no convenient way for adjusting the spark gap so that the voltage limitations placed on the system could not readily be varied. While the ignition systems with these spark boosters were more efficient than systems without spark boosters, nevertheless, they failed to maximize engine performance in response to different performance conditions.

SUMMARY OF THE INVENTION

With the foregoing in mind, and with the intention of overcoming these disadvantages, the present invention relates generally to a spark boosting device for the ignition system of an internal combustion engine. It comprises first and second electrically conductive members which are spaced from each other to define a spark gap and means for varying the distance across the spark gap in response to variations in temperature.

Another aspect of the invention relates to a spark booster having first and second electrically conductive members and means for varying the distance across the spark gap in response to variations in temperature, and in response to variations in a vacuum which is applied to the device.

For the purpose of illustrating the invention, there are shown in the drawings embodiments which are presently preferred, it being understood, however, that this invention is not limited to the precise arrangements and instrumentalities shown, and wherein:

DESCRIPTION OF THE PREFERRED EMBODIMENTS OF THE INVENTION

Figure 1:
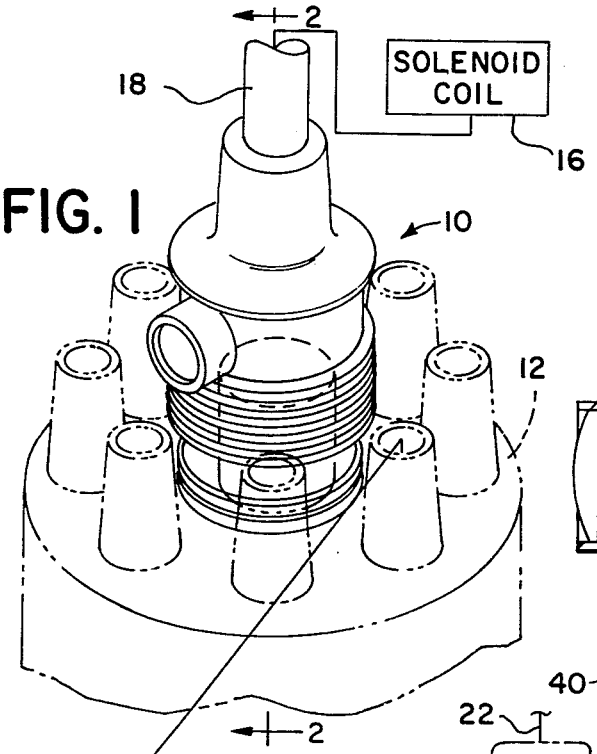
FIG. 1 is a perspective view of one embodiment of the invention mounted on the cap of a distributor.

Referring to the drawing for a detailed description of the invention, a spark booster 10 is shown connected between the voltage input in the cap of a distributor 12 and the solenoid coil 16 (shown schematically) by which it is energized.

The spark booster is connected to the solenoid coil by way of conductor 18. The distributor 12 is connected to a plurality of spark plugs 20 by suitable conductors 22 in a manner which is well known. In an ignition system of the type which relates to the present invention, a relatively high voltage source such as the solenoid 16 provides voltage by way of conductor 18 and the spark booster 10 to the conductors 22 and spark plugs 20.

The booster 10 may be mounted at any convenient location in the ignition system between the solenoid and the spark plugs. Conveniently, the booster may be connected between the solenoid coil and the distributor cap, or between the distributor and the spark plugs. For the purposes of simplifying the explanation of the manner in which the spark booster 10 operates, it has been illustrated in FIGS. 1 and 2 coupled between the solenoid coil and the distributor cap.

The spark booster 10 is operative to increase the voltage at the spark plug for reasons which are well known in the art and need not be discussed herein.

Figure 2:
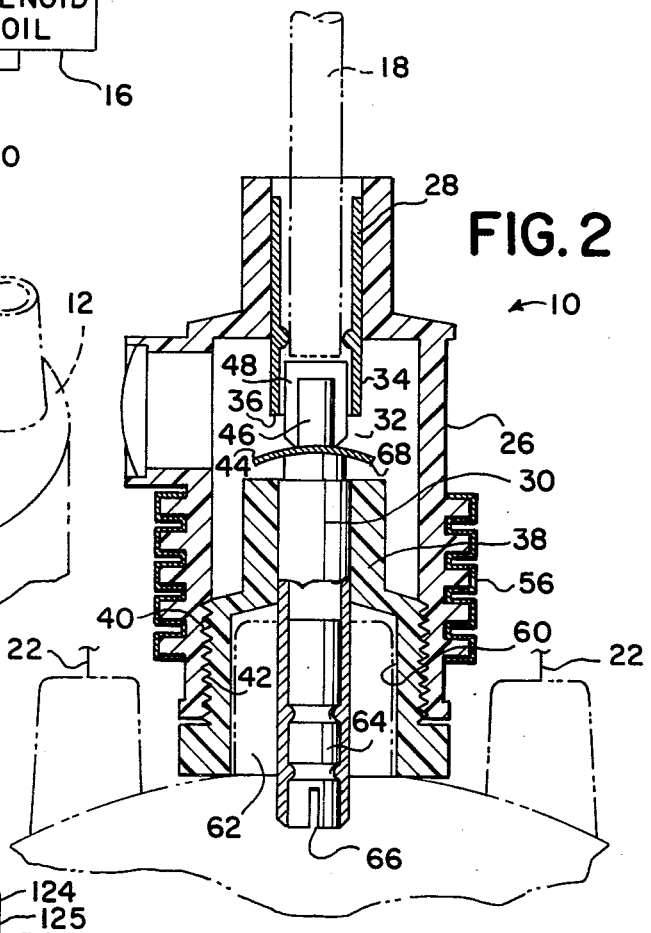
FIG. 2 is a sectional view taken along Line 2—2 of FIG. 1, looking in the direction of the arrows.

Referring now to FIG. 2, the spark booster 10 comprises a generally cylindrical outer housing 26 which is comprised of electrically non-conductive materials. It supports first and second electrically conductive members 28 and 30. The members are spaced from each other to define a spark gap 32.

Electrically conductive member 28 may be an elongated open ended cylinder which is supported at the upper end of housing 26.

As will be apparent from what follows, it is not essential that member 28 be hollow for its entire length. However, for the purposes of this invention at least the lower portion should be hollow so that a peripheral wall 34 housing a downwardly facing edge 36 is defined.

Electrically conductive member 30 is supported in a sleeve 38 having threads formed in its outer wall which threads are received in complimentary threads 42 in the lower portion of housing 26.

The upper part of conductive member 30 comprises a ledge on which a bimetallic element 44 is supported. The bimetallic element 44 is generally flat and lies in a plane which is generally perpendicular to the axis defined by the facing ends of electrically conductive members 28 and 30. A portion 46 of member 30 extends upwardly of the ledge and is encased in a cap 48 comprised of a suitable non-conductive material such as ceramic.

An aperture 50 formed in the side wall of the housing 26 adjacent the spark gap 32 has a laterally extending cylindrical wall 52 supported on its periphery. The distal end of wall 52 may support a magnifying lens 54. The aperture permits manual observation of the spark. The lens 54 may be used if desired to magnify the spark gap so that it can be more readily examined.

A shield 56 comprised of a suitable metal such as steel, tin or aluminum is disposed around the periphery of the housing. The shield is operative to electrically isolate the spark gap from static electricity which might be generated while the ignition system is energized.

The lower portion of sleeve 38 is hollowed at 60 in order to accommodate the upwardly extending boss 62 which comprises the voltage input to the distributor. The distal end 64 of conductive member 30 may be slotted at 66.

In order to connect the spark booster between the solenoid coil 16 and the distributor cap 12, conductor 18 is inserted into the upper end of conductive member 28 and the distal end 64 of conductive member 30 is inserted into the distributor cap or coil.

The spark gap is defined between the periphery 68 of the bimetallic element 44 and the edge 36 of peripheral wall 34. The distance across the spark gap can be adjusted by rotating the sleeve 38 with respect to the housing 26.

Once an appropriate spark gap distance has been manually set, further variations in its size will occur in response to changes in temperature in the housing which are reflected in changes in the temperature of the bimetallic element 44.

Thus, when the engine is cold, the bimetallic element 44 is disposed in the configuration illustrated where the distance across the spark gap is maximized. However, as the bimetallic element warms up in response to increased temperature of the engine, its periphery 68 will move upwardly thereby reducing the distance across the spark gap.

This arrangement results in a hotter spark being delivered to the spark plug when the engine is cold and the fuel mixture is richest and a reduced spark being delivered to the spark plug when the engine is warm and the mixture is leaner.

Figure 3:
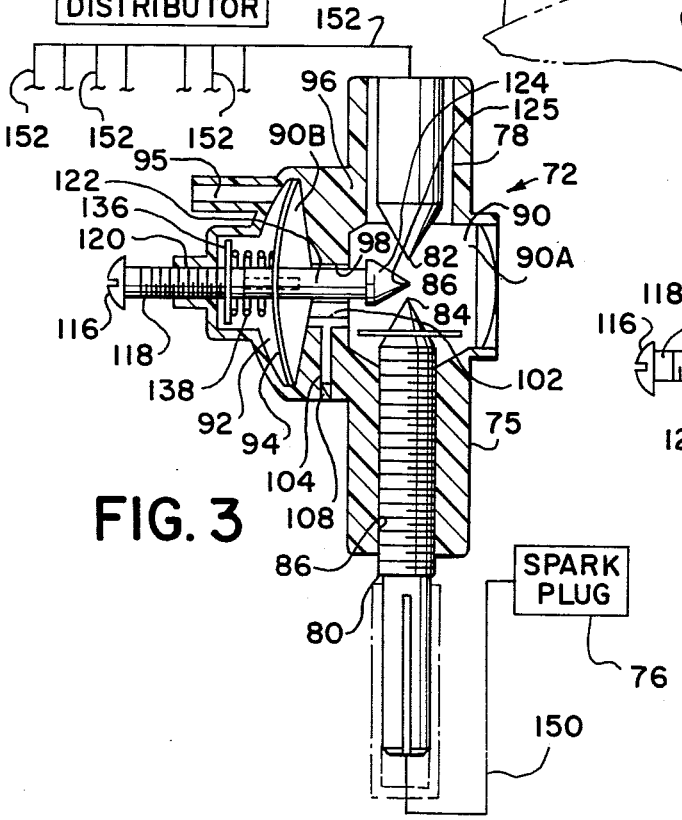
FIG. 3 is a sectional view taken through a second embodiment of the invention mounted between a distributor and a spark plug and being in a first operating condition.
Figure 4:
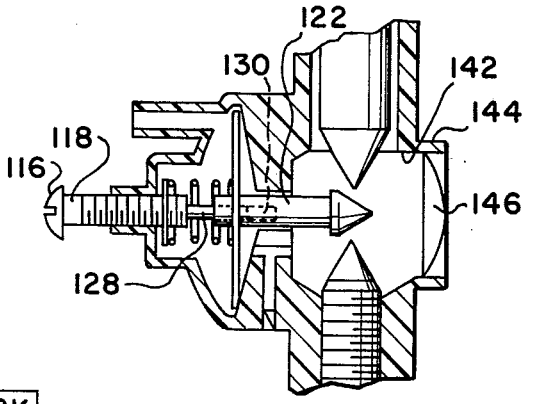
FIG. 4 is a view of a portion of the device illustrated in FIG. 3, showing the device in a second operating condition.

In FIGS. 3 and 4 a second presently preferred embodiment of the spark booster 72 is illustrated. This embodiment operates in substantially the same way as the embodiment illustrated in FIGS. 1 and 2. However, in this embodiment the distance across the spark gap, in addition to varying in response to temperature, also varies in response to the load on the engine. The spark booster 72 is connected between the distributor 74 and one of the spark plugs 76. It should be appreciated that either embodiment of the invention can be connected to the ignition system as just described or as described in connection with FIGS. 1 and 2. However, if the spark booster is connected directly to the spark plugs, one spark booster for each spark plug is required.

Spark booster 72 comprises a generally cylindrical housing 75 which is comprised of electrically non-conductive material. It supports first and second electrically conductive members 78 and 80. The facing ends of members 78 and 80 are tapered to define points 82 and 84. The spark gap 86 is defined by the distance between points 82 and 84. Conductive member 78 may be fixed to the housing 75 while member 80 may be provided with threads 88 so that it can be moved axially to manually increase or reduce the distance across the spark gap 86 as desired. The housing 75 comprises first and second chambers 90 and 92 which are separated by a flexible wall 94. Chamber 92 is connected by a conduit 95 to a suitable source of vacuum such as the carburetor or intake manifold of the engine. Chamber 90 is divided into two sections 90A and 90B by a wall 96 which has an aperture 98 connecting those sections. The wall 96 has a surface 100 which faces the flexible wall 94 and thereby provides a limit on the displacement of the wall 94. The aperture 98 slidably receives a portion of a third member 116 as will be more completely described herein.

Sections 90A and 90B are also interconnected by a conduit 102 which is also connected to ambient air by way of a second conduit 104. Access of ambient air to conduit 104 is controlled by a check valve 108 (illustrated schematically) which is operative to permit air to leave chamber 90 but not to enter it.

Third member 116 may have a fixed generally elongated configuration and include a non-conductive portion 118 which is threadingly received in an aperture 120 disposed in the sidewall of the housing 75 so that it can be advanced or withdrawn therefrom. Non-conductive portion 118 is connected to a second movable portion 122. The end 124 of the movable portion is tapered to a point 125. At least end 124 of portion 122 is conductive the remainder of portion 122 is non-conductive.

The portions 118 and 122 are slidingly interconnected to each other so that even though while portion 118 is fixed to the housing, portion 122 can move axially relative thereto. A suitable interconnection means may be provided by forming a relatively long forwardly extending pin 128 on the front face of portion 118 and forming a complimentary recess 130 in portion 122 (FIG. 4).

The flexible wall 94 is fixed to movable portion 122 and controls its axial displacement relative to fixed portion 118.

A bimetallic element 136 is fixed to fixed portion 118. A helical compression spring 138 of suitable light weight is disposed between and bears against the bimetallic element 136 and the flexible wall 94.

Movement of the conductive portion 124 into and out of the spark gap 86 reduces the open distance between points 82 and 84 by the distance across end 124 when it is disposed between the tips.

Additionally, if desired suitable means for observing the spark gap in the form of an aperture 142 in the side wall of the housing 75 which supports a wall 144 on which magnifying lens 146 may be provided.

The manner in which this embodiment of the invention operates is similar to that which has been described. Thus it may be, as shown as an example, be connected to a spark plug 76 by a conductor 150 with a suitable receptacle for telescopically receiving the distal end of conductive member 80. It may be connected to the distributor by a suitable conductor 152. A conductor 150, a conductor 152 and a spark booster 72 is required for each spark plug 76 when the spark booster is disposed between the distributor and the spark plugs.

When this embodiment of the spark booster is used, conduit 95 is connected to the source of vacuum and the distance across the spark gap 86 is manually adjusted to the desired distance.

As the temperature of the engine changes, and as the load which it is required to bear varies, the movable portion 122 of the third member will be displaced to the left or right under the influence of the flexible wall 94 and the bimetallic element 136.

Thus, when first started, the engine is cold and a hot spark is desired. In order to accomplish this, the full distance between tips 82 and 84 should be available to develop the spark. The spark booster accomplishes this objective since the bimetallic element is flat and therefore is not compressing the spring, while the vacuum is being drawn through conduit 95 (the engine is cold) causes the flexible wall 94 and the movable portion 122 to move to the left so its conductive end 124 is out of the spark gap. If the load in the engine should ease before it is heated, the vacuum drawn through conduit 95 will increase. The performance characteristics of the ignition system are not as demanding with a reduced load and a wider secondary gap (86) is desirable. The wider spark gap is obtained since the increase in vacuum suction draws movable portion 122 to the left and allows the conductive end 124 to move away from the spark gap 86 thereby increasing the open distance between tips 82 and 84 (FIG. 4).

As the engine becomes warmer, a narrower spark gap becomes desirable. The device responds to this condition since the warm bimetallic element 136 will flex, thereby tending to compress spring 138 so that it urges the flexible wall 94 to the right. Since movable portion 122 is connected to the flexible wall 94 it also moves to the right so that its conductive end 124 moves into the spark gap 86 space between tips 82 and 84. This has the effect of reducing the spark gap by the distance across end 124. Since end 124 is tapered, the reduction in distance will vary in proportion to the extent to which the end is interposed between tips 82 and 84.

Displacement of conductive end 124 in response to a vacuum on conduit 95 is independent of temperature. Such a vacuum may represent an increase in the load felt by the engine and may typically occur if the engine is run at very high speeds, is accelerated, or if the vehicle is overloaded or if the vehicle goes uphill.

Sensing the increase in load, vacuum pull is reduced and the flexible wall 94 is displaced to the right thereby reducing the spark gap. After the load on the engine is reduced, the vacuum felt through conduit 95 is increased and the flexible wall 94 returns to its flexed or compressed configuration. This has the effect of moving end 124 away from the spark gap 86 so that the distance across the spark gap is increased by the distance across end 124. The air in which is contained in chamber 90 is exhausted through conduits 102 and 104 and check valve 108.

While the invention has been described with respect to certain embodiments, it is apparent that many other embodiments will be obvious to those skilled in the art in view of the foregoing disclosure. Thus, the scope of the invention should not be limited by the foregoing disclosure, but, rather, only by the scope of the claims appended hereto.

We claim:

1. A spark booster for the ignition system of an internal combustion engine comprising a housing, said housing being made of electrically non-conductive material;

first and second electrically conductive members supported by said housing, said members being in axial alignment and being longitudinally spaced from each other to define a spark gap, an electrically conductive bimetallic element which moves laterally and is disposed in said housing for axially varying the distance across said spark gap in response to variations in the temperature in said housing so that increases in temperature causes said spark gap to be reduced.

2. A device as defined in claim 1 wherein said varying means comprises a bimetallic element and a third member, said third member being coupled to said bimetallic element, at least a portion of said third member being comprised of electrically conductive material, and said bimetallic element is operative to move said electrically conductive portion of said third member into said spark gap as the temperature of said bimetallic element increases thereby reducing the size of said spark gap.

3. A device as defined in claim 2 wherein said housing comprises first and second chambers which are separated by a flexible wall and a conduit connecting one of said chambers to a source of vacuum said third member being coupled to said flexible wall so that said conductive portion of said third member moves into and out of said spark gap in response to reductions and increases in the vacuum drawn by said source, and the movement of said third member in response to said vacuum is independent of its movement in response to said bimetallic element.

4. A device as defined in claim 3 wherein said other chamber includes said spark gap, and said housing comprises an aperture to permit said spark gap to be observed.

5. A device as defined in claim 4 including a magnifying lense, and said lens is supported in said aperture.

6. A device as defined in claim 2 wherein one of said electrically conductive members is elongated and is threadingly received in said housing to enable that member to be moved axially relative to said other electrically conductive member as it is rotated to vary said spark gap independently of said third member.

7. A device as defined in claim 3 wherein said third member is elongated and comprises first and second portions which are axially slidable with respect to each other, the portion of said third member that is non-conductive being fixed to said housing, and the movable portion of said third member comprises its conductive portion.

8. A device as defined in claim 7 wherein said bimetallic member is fixed to said fixed portion of said third and bears against said flexible wall, and said flexible wall being connected to said movable portion of said third member so that movement of the conductive portion of said third portion is responsive to the temperature of said bimetallic element and the vacuum applied to said conduit.

9. A device as defined in claim 19 wherein the facing ends of said first and second members are tapered to substantially define points, said spark gap being defined by said points, and the portion of said third member that is movable into said spark gap is tapered to substantially define a point.

10. A device as defined in claim 3 wherein each of said first and second electrically conductive members is connected to an electrically conductive device, and means are provided for raising one of said electrically conductive devices to a higher electrical potential than the other.

11. A device as defined in claim 10 wherein one of said electrically conductive devices is a distributor and the other electrically conductive device is a conductor and a source of electrical potential, said distributor being connected to its respective electrically conductive member at the voltage impact of said distributor.

12. A spark booster for the ignition system of an internal combustion engine comprising a housing, said housing being made of electrically non-conductive material, first and second electrically conductive members supported by said housing, said members being spaced from each other and having facing ends to define a spark gap;

an electrically conductive bimetallic element disposed in said housing for varying the distance across said spark gap in response to variations in the temperature in said housing so that increases in temperature cause said spark gap to be reduced, said bimetallic element being mounted on at least one of said electrically conductive members, the said facing ends of said first and second members being in axial alignment, said bimetallic element being a generally planar member which is mounted on one of said members in a plane which is perpendicular to said axis of alignment and the other of said members having at least a hollow end in facing relation to said bimetallic element to define a peripheral wall in facing relation to said bimetallic element so that said spark gap is defined by the distance between said bimetallic element and said circumferential wall.

13. A device as defined in claim 12 wherein each of said first and second members is connected to an electrically conductive device, and means are provided for raising one of said electrically conductive devices to higher electrical potential than the other.

14. A device as defined in claim 13 wherein one of said electrically conductive devices is a distributor and the other electrically conductive device is a conductor and a source of electrical potential, said distributor being connected to its respective electrically conductive member at the voltage input of said distributor.

15. A device as defined in claim 12 wherein said housing includes an aperture to enable said spark gap to be observed.

16. A device as defined in claim 15 including a magnifying lens, said lens being supported in said aperture.

17. A device as defined in claim 16 including a metallic static shield supported by said housing.

18. A device as defined in claim 12 including means mounted on said housing for displacing at least one of said conductive members relative to the other for varying said spark gap independently of temperature.

19. A device as defined in claim 18 wherein said last named means comprises a sleeve, said sleeve supporting one of said conductive members, said sleeve being threadingly received in said housing so that axial movement of said sleeve and said conductive member is caused by rotating said sleeve relative to said housing.

20. A device as defined in claim 12 including a non-conductive member, said non-conductive member overlying and being mounted on said bimetallic element so that said bimetallic element extends radially outwardly of said non-conductive member to enable a spark to be distributed over the entire area of said bimetallic element and said circumferential wall.

* * * * *